US006488552B2

(12) United States Patent
Kitsu et al.

(10) Patent No.: US 6,488,552 B2
(45) Date of Patent: Dec. 3, 2002

(54) OUTBOARD ENGINE

(75) Inventors: Kunihiro Kitsu, Wako (JP); Hideki Nemoto, Wako (JP); Nobuo Haga, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/751,359

(22) Filed: Dec. 28, 2000

(65) Prior Publication Data

US 2001/0012740 A1 Aug. 9, 2001

(30) Foreign Application Priority Data

Jan. 14, 2000 (JP) ..... 2000-006535

(51) Int. Cl.[7] ..... B63H 21/36
(52) U.S. Cl. ..... 440/77
(58) Field of Search ..... 440/76, 77, 88

(56) References Cited

U.S. PATENT DOCUMENTS 4,722,709 A * 2/1988 Irwin et al. ..... 440/89
4,734,070 A * 3/1988 Mondeck ..... 440/88
4,800,854 A * 1/1989 Boda et al. ..... 123/195 P
4,969,848 A * 11/1990 Isogawa ..... 440/77
5,445,548 A * 8/1995 Koishikawa et al. ..... 440/89
5,899,778 A * 5/1999 Hiraoka et al. ..... 440/88
5,984,742 A * 11/1999 Kimura et al. ..... 440/77
6,024,616 A * 2/2000 Takayanagi ..... 440/77
6,149,477 A * 11/2000 Toyama ..... 440/88

FOREIGN PATENT DOCUMENTS

JP 5975398 5/1984

* cited by examiner

*Primary Examiner*—S. Joseph Morano
*Assistant Examiner*—Andrew Wright
(74) *Attorney, Agent, or Firm*—Carrier, Blackman & Associates, P.C.; Joseph P. Carrier; William D. Blackman

(57) ABSTRACT

An outboard engine comprises: a power unit including a body structure, an engine (10) disposed in an upper portion of the body structure, a propeller shaft (25) supported for rotation on a lower portion of the body structure so as to be driven by the engine (10), and a cowling (5) detachably attached to the body structure so as to cover the engine (10) from above and to defining a part of an engine room (6). A tilt bracket (35) connected to the body structure of the power unit is connected pivotally to a stern bracket (36) clamped to a boat by a tilt shaft (37). The cowling (5) is provided integrally with a tilt handle (80) to be gripped by hand when tilting the power unit, and an air inlet structure (70) through which air is introduced into the engine room (6).

18 Claims, 8 Drawing Sheets

OUTBOARD ENGINE

BACKGROUND OF THE INVENTION

1. Field of the Invention

The present invention relates to an outboard engine detachably clamped to the transom of a boat to propel the boat.

2. Description of the Related Art

An outboard engine has a cowling defining an engine room or space and provided with a tilt handle that is used for tilting a power unit of the outboard engine on a tilt shaft. Generally, the tilt handle is formed so that the fingers of a hand gripping the tilt handle extend through an opening formed in the cowling into the engine room. This opening is used as an air inlet opening.

An outboard engine disclosed in JP-U No. Sho 59-75398 has a cowling provided with a tilt handle and an air inlet opening. In this prior art outboard engine, either the tilt handle or an air inlet duct is formed integrally with the cowling and the other of the tilt handle or the air inlet duct is fastened to the cowling with screws. Thus either the tilt handle or the air inlet duct, is formed separately from the cowling and must be fastened to the cowling with screws. Therefore, the manufacture of the outboard engine needs many man-hours for making its component parts and assembling the same, which increases the manufacturing cost of the outboard engine.

SUMMARY OF THE INVENTION

The present invention has been made in view of such a problem and it is there for an object of the present invention, to provide an outboard engine including a cowling integrally provided with a tilt handle and an air inlet structure, which is not require many man-hours for making separate component parts and assembling the same, and which is capable of being manufactured at a low manufacturing cost.

According to a one aspect of the present invention, an outboard engine comprises: a power unit including a body structure, an engine disposed on an upper portion of the body structure, a propeller shaft supported for rotation on a lower portion of the body structure so as to be driven by the engine, and a cowling detachably joined to the body structure so as to cover the engine from above and to define a part of an engine room; a tilt bracket connected to the body structure of the power unit; a stern bracket to be clamped to a boat; and a tilt shaft pivotally connecting the tilt bracket to the stern bracket; wherein the cowling is provided integrally with a tilt handle to be gripped by hand when tilting the power unit, and an air inlet structure.

Formation of the tilt handle and the air inlet structure integrally with the cowling reduces man-hours for making the component parts and assembling the same, and thus also reduces the manufacturing cost.

Preferably, the cowling of the outboard engine according to the present invention has the shape of an inverted bowl having a substantially horizontal top wall and a side wall, an outer opening of the air inlet structure is formed in an upper rear portion of the side wall, a wall is extended substantially horizontally from an upper brim of the opening into a space defined by the cowling to form a horizontal handgrip, and the tilt handle includes a rear end portion of the substantially horizontal top wall, an upper rear end portion of the side wall, extending over the outer opening, and the horizontal handgrip. The tilt handle thus formed has a sufficiently high rigidity.

Preferably, the air inlet structure includes a horizontal tube having walls substantially horizontally extending from a lower brim and opposite side brims of the outer opening formed in the side wall of the cowling into the engine room defined by the cowling, and the horizontal handgrip that serves as an upper wall of the horizontal tube. An inner end portion of the lower wall of horizontal tube is bent upward in a vertical wall having an upper edge on a level lower than that of the horizontal handgrip to define an inner opening of the air inlet structure together with the horizontal handgrip.

Air flows through the outer opening formed in the rear portion of the cowling through the horizontal tube into the engine room. Since the inner end portion of the lower wall of the horizontal tube is bent upward to form the vertical wall, water that enters the horizontal tube together with air is stopped by the vertical wall so that the water can be-separated from the air to some extent.

Preferably, a vertical tube is extended substantially vertically downward from the inner end of the horizontal tube, the air inlet structure includes the horizontal tube and the vertical tube, the upper surface of the engine is covered with a covering member having a bottom wall and a side wall and defining a cavity opening upward, and the lower end of the vertical tube opens into the cavity defined by the covering member.

Even if water which has entered the horizontal tube through the outer opening formed in the cowl flows beyond the vertical wall into the vertical tube, the water flows through the lower open end of the vertical tube into the cavity of the covering member and does not spread in the engine room.

Preferably, the covering member is provided in its bottom wall with drain holes to drain water collected in the cavity of the covering member outside the engine room.

Preferably, the covering member serves also as a belt cover for covering a timing belt, and the drain holes are formed in portions of the covering member near the tilt shaft and drain pipes extending outside from the engine room are connected to the drain holes. The use of the covering member also as a belt cover reduces the number of component parts, and the water collected in the covering member can be surely drained outside the engine room when the outboard engine is in either a tilted-up state or a steering state because the drain holes are formed at positions facing toward the tilt shaft.

BRIEF DESCRIPTION OF THE DRAWINGS

The above and other objects features and advantages of the present invention will become more apparent from the following description taken in connection with the accompanying drawings, in which.

DESCRIPTION OF THE PREFERRED EMBODIMENTS

Figure 1:
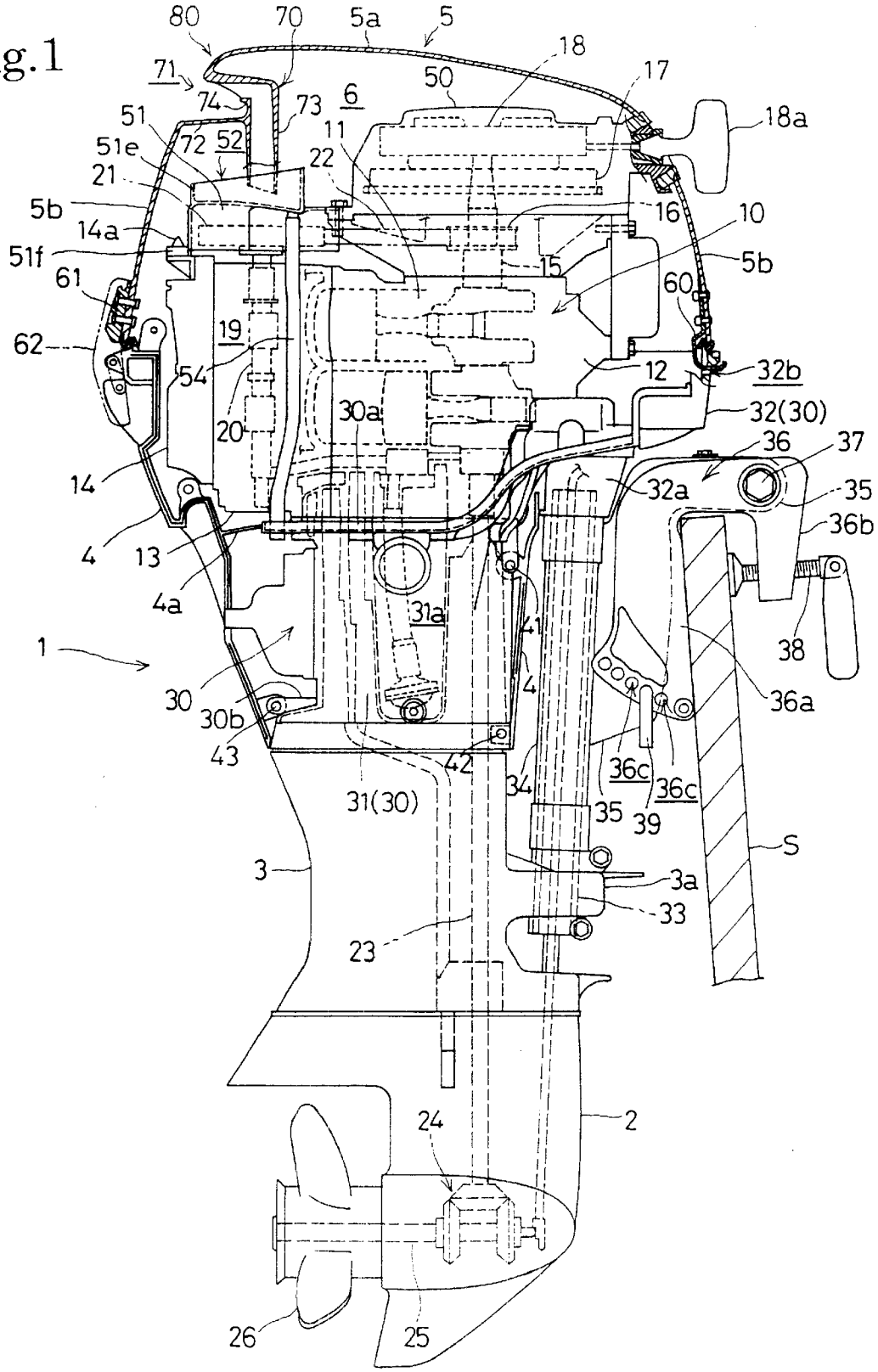
FIG. 1 is a side elevational view of an outboard engine in a preferred embodiment according to the present invention, in which a cover is shown in a sectional view.
Figure 2:
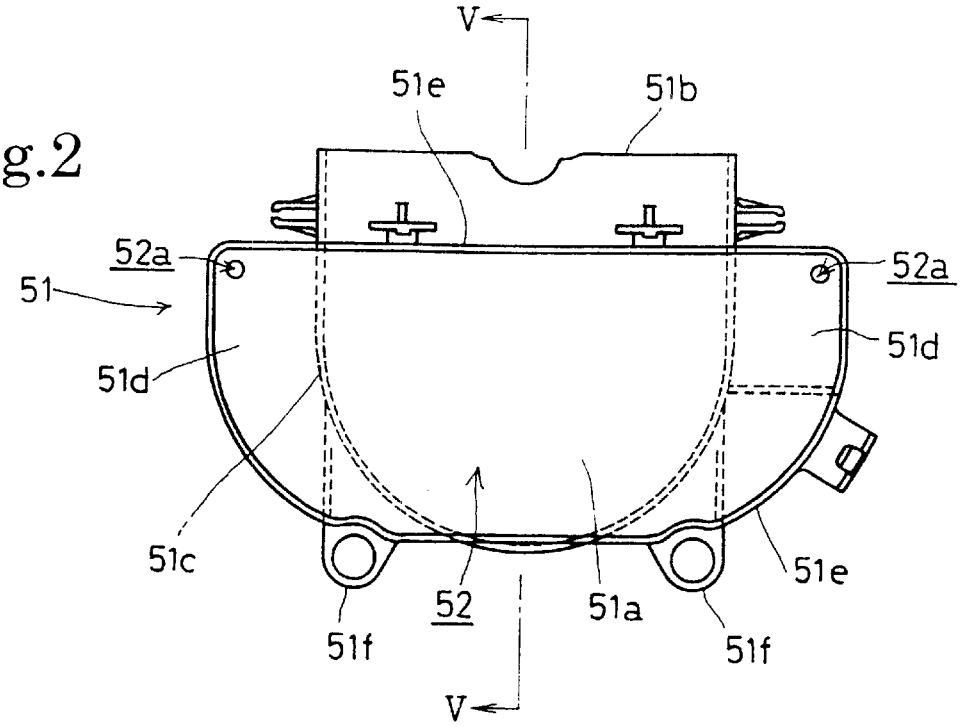
FIG. 2 is a top view of a second cover.
Figure 3:
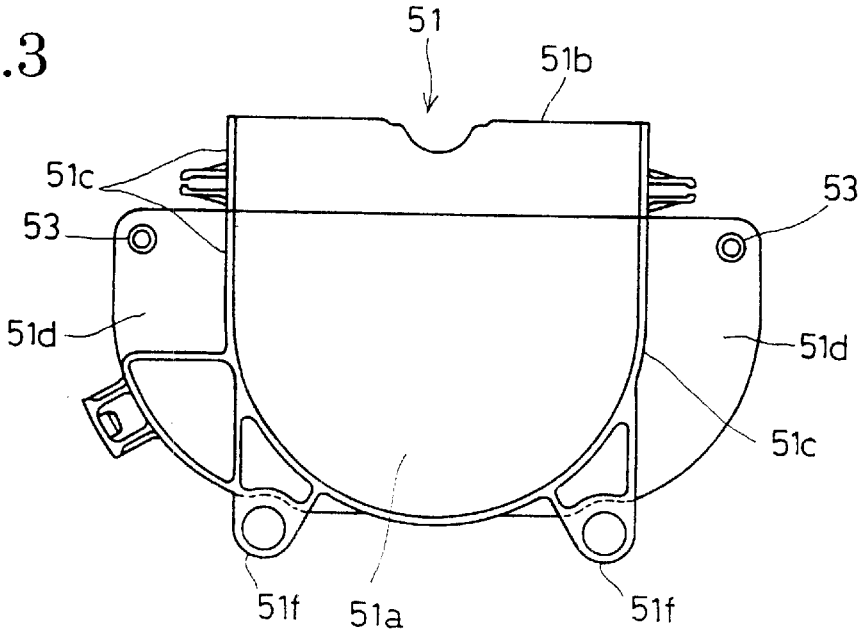
FIG. 3 is a bottom view of the second cover shown in FIG. 2.
Figure 4:
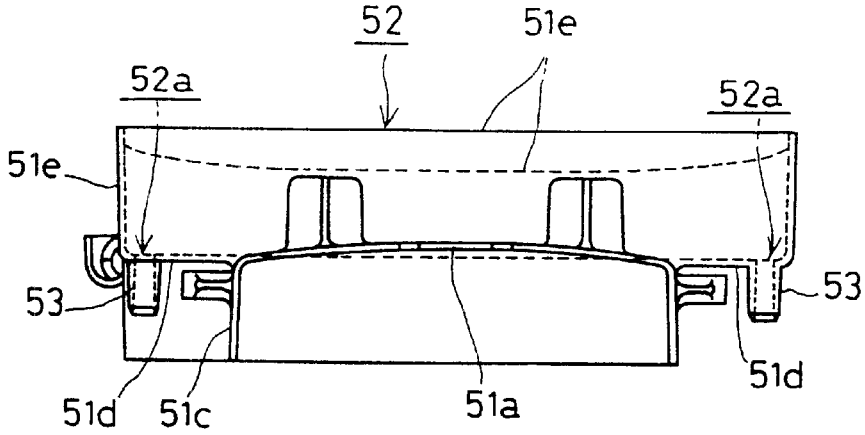
FIG. 4 is a front elevational view of the second cover shown in FIG. 2.
Figure 5:
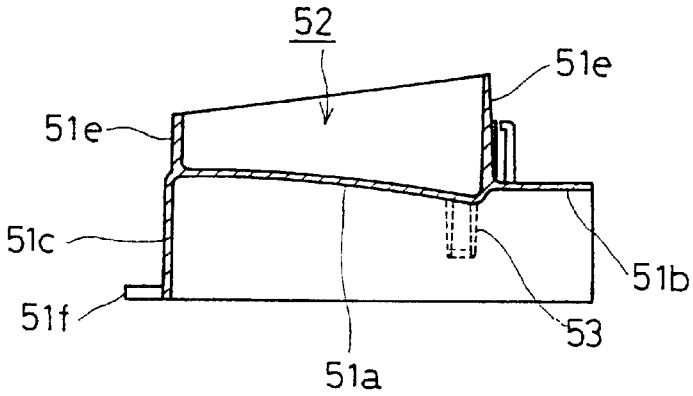
FIG. 5 is a sectional view taken on line V—V in FIG. 2.
Figure 6:
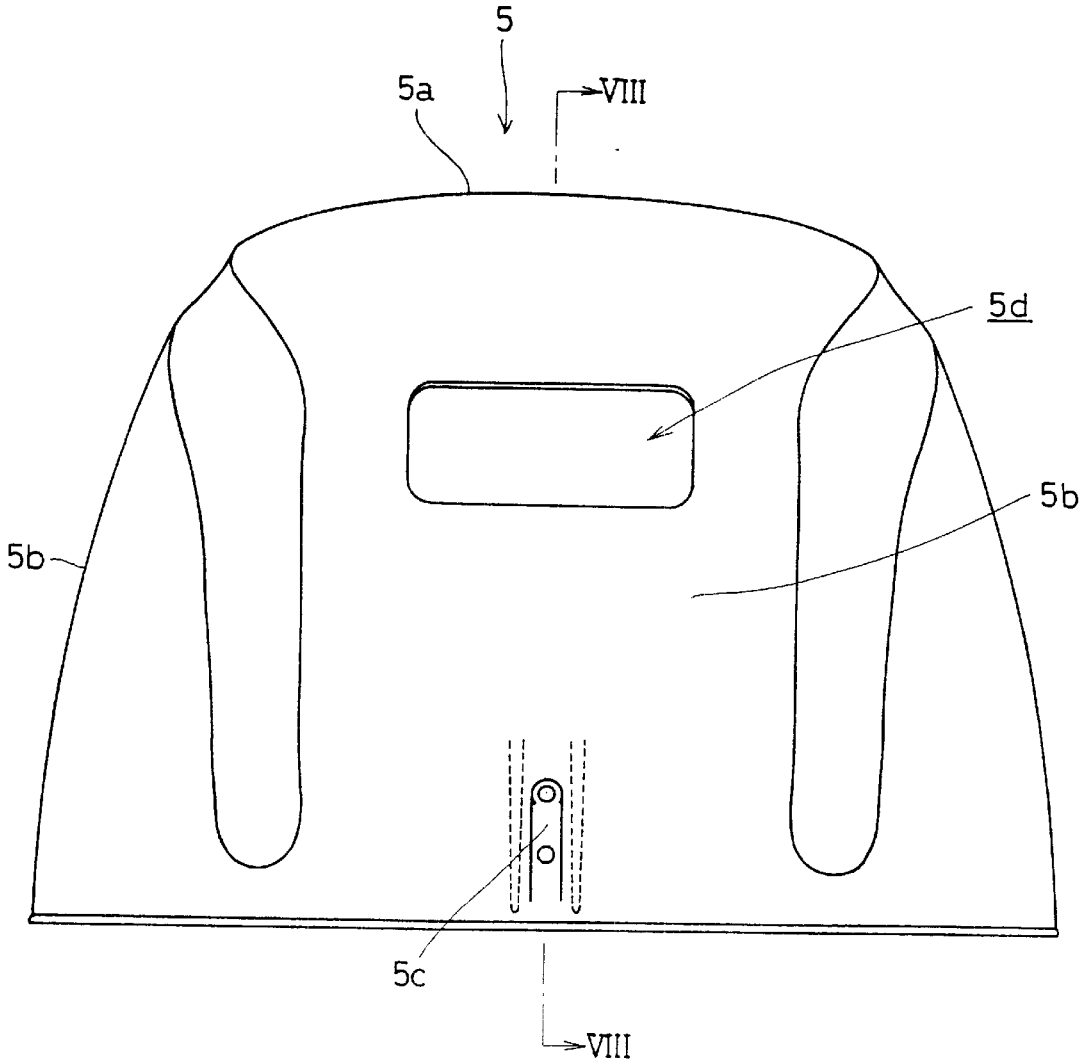
FIG. 6 is a front elevational view of a cowling.
Figure 7:
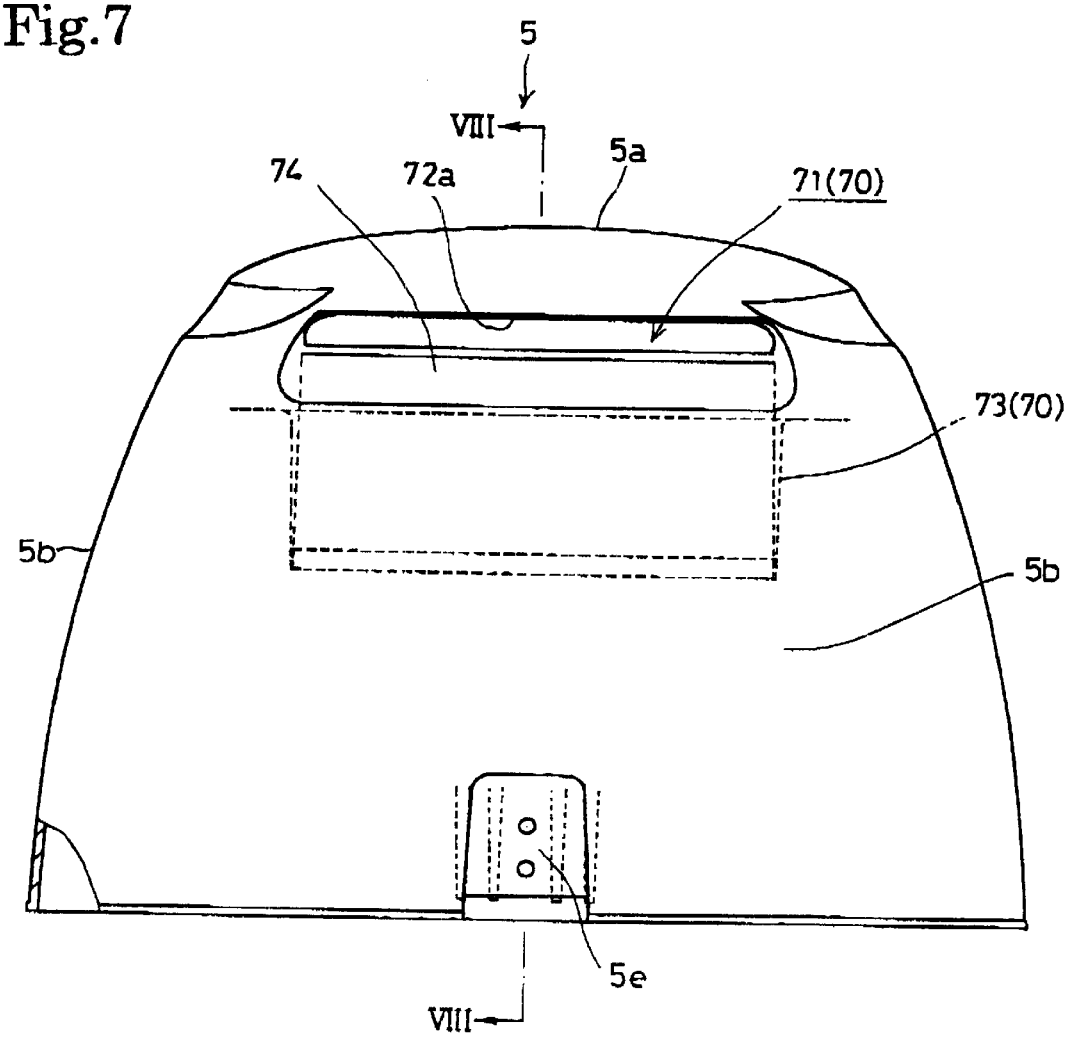
FIG. 7 is a rear view of the cowling shown in FIG. 6.
Figure 8:
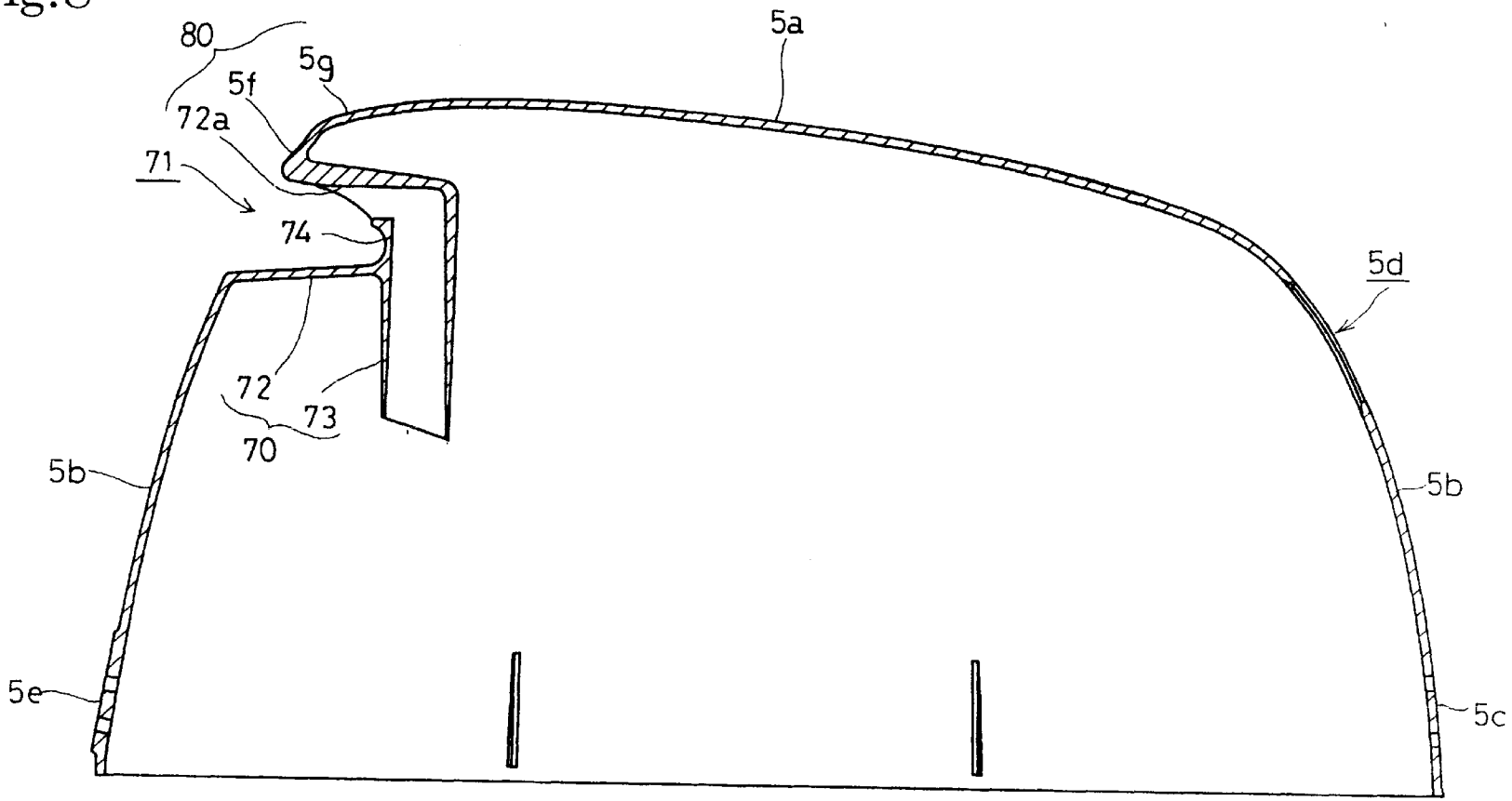
FIG. 8 is a sectional view taken on line VIII—VIII in FIG. 6 or 7.

An outboard engine 1 in a preferred embodiment according to the present invention will be described with reference to FIGS. 1 to 9. Referring to FIG. 1, the outboard engine 1 comprises an engine unit, a swivel shaft 33 fixedly connected to the engine unit, a swivel case 34 rotatably supporting the swivel shaft 33, and a stern bracket 36 to be clamped to a stern member S of a boat. The power unit of the outboard engine 1 has a gear case 2 supporting a propeller shaft 25 fixedly provided with a propeller 26, an extension case 3 joined to the upper end of the gear case 2, an under cover 4 joined to the upper end of the extension case 3, and a cowling 5 detachably joined to the upper end of the under cover 4. An expanded upper portion of the under cover 4 and the cowling 5 define an engine room 6. An engine 10 and engine accessories are contained in the engine room 6. The engine 10 has an engine block 11 provided with two cylinders formed in a vertical arrangement. A crankshaft 15 is disposed in a vertical position. A crankcase 12 is attached to the front surface, i.e., the right surface as viewed in FIG. 1, of the engine block 11. A cylinder head cover 14 is attached to a cylinder head 13 attached to the rear surface, i.e., the left surface as viewed in FIG. 1, of the engine block 11. In FIG. 1, pistons fitted in the upper and the lower cylinder of the engine block 11 are at the top dead center and the bottom dead center, respectively. The engine 10 is a two-cylinder four-stroke cycle engine.

A camshaft driving pulley 16, the rotor of an ac generator 17 and a recoil starter pulley 18 are mounted and arranged upward in that order on an upper end portion of the crankshaft 15 projecting from the engine block 11. A camshaft 20 is disposed in a cam chamber 19 formed behind the cylinder head 13. A cam pulley 21 is mounted on an upper end portion of the cam shaft 20 projecting upward from the cam chamber 19. A timing belt 22 is extended between the cam pulley 21 and the camshaft driving pulley 16. The camshaft 20 is rotated at a rotating speed half that of the crankshaft 15. A valve mechanism, not shown, is disposed in the cam chamber 19. The cam shaft 20 drives the cam mechanism to drive inlet valves for opening and closing inlet ports, and exhaust valves for opening and closing exhaust ports. Engine cooling water is sucked through a suction opening formed near the lower end of the extension case 3.

The engine 10 of the outboard engine 1 having the engine block 11 and the engine accessories is fixed to the upper end of an oil case 30 disposed under the engine block 11. Substantially the entire weight of the engine 10 is born by the oil case 30. The oil case 30 is formed of an aluminum alloy by die casting and has a high rigidity. The oil case 30 is firmly held on the upper end of the extension case 3. The extension case is formed of an aluminum alloy by die casting and has a high rigidity.

The lower end of the crankshaft 15 is coupled with a driving shaft 23. The driving shaft 23 extends downward through the extension case 3 and is interlocked with the propeller shaft 25 by a bevel-gear-and-dog-clutch type reversing mechanism 24. The propeller 26 is attached to the rear end of the propeller shaft 25. The rotation of the crankshaft 15 is transmitted through the driving shaft 23, the reversing mechanism 24 and the propeller shaft 25 to the propeller 26.

The oil case 30 has a case body 31 provided with a central oil reserving portion 31*a*, and a extension part 32 extending obliquely upward from an upper front portion of the case body 31. The extension part 32 bears part of the weight of the engine 10. The extension part 32 has a holding portion 32*a*. The upper end of the swivel shaft 33 is held fixedly by the holding portion 32*a*. The lower end of the swivel shaft 33 is held fixedly by a holding portion 3*a* projecting forward from the front surface of the extension case 3. The swivel shaft 33 thus fixed to the engine unit including the engine 10 and the accessories is supported rotatably in the swivel case 34, i.e., a tubular bearing, extended between the holding portions 32*a* and 3*a*. A swivel bracket 35 is formed integrally with the swivel case 34 so as to extend forward. The swivel bracket 35 has an upper arm extending forward. A front end portion of the upper arm is joined pivotally to the stern bracket 36 fixed to the stern member S of the boat by a tilt shaft 37. The stern bracket 36 has a long portion 36*a* and a short portion 36*b* and is formed in the shape of the letter J in a side view. Clamping screws 38 are screwed in threaded holes formed in the short portion 36*b* of the stern bracket 36. An upper edge portion of the stern member S is inserted in a space between the long portion 36*a* and the short portion 36*b* of the stern bracket 36. The clamping screws 38 are turned to clamp the stern bracket 36 to the stern member S by pressing the inner surface of the long portion 36*a* against the outer surface of the stern member S.

A plurality of holes 36*c* are formed in a lower end portion of the long portion 36*a* on an arc of a circle having its center on the axis of the tilt shaft 37. The engine unit of the outboard engine 1 is turned on the tilt shaft 37 to set the engine unit of the outboard engine 1 at a desired tilt angle with a hole formed in the swivel bracket 36 aligned with one of the plurality of holes 36*c*. Then, a pin 39 is inserted in the hole of the swivel bracket 36 and the hole 36*c* of the long portion 36*a* aligned with the hole of the swivel bracket 36 to hold the engine unit of the outboard engine 1 at the desired tilt angle. Thus, the swivel bracket 35 can be turned on the tilt shaft 37 for tilt angle adjustment relative to the stern bracket 36, and the engine unit of the outboard engine 1 can be turned for steering about the substantially vertical axis of the swivel case 34 while the boat is running.

The under cover 4 covering the oil case 30 is formed by joining together right and left half covers with the oil case 30 and the engine 10 interposed between the right and the left half case. Respective rear portions of the right and the left half case are joined together so as to cover rear portions of the oil case 30 and the engine 10, and the respective front portions of the right and the left half case are joined together so as to cover front portions of the oil case 30 and the engine 10. The lower surface of the extension part 32 is not covered with the under cover 4, and the holding portion 32*a* holding the upper end of the swivel shaft 33 projects outside from the under cover 4. Bosses formed at upper and lower positions on a joint surface in a front lower portion of the under cover 4 are fastened to holding portions of the case body 31 of the oil case 30 with bolts 41 and 42, and a boss formed at a lower position on a joint surface in a rear lower portion of the under cover 4 is fastened to holding portion 30*b* of the oil case 30 with a bolt 43.

As mentioned above, the extension part 32 extends obliquely upward from the upper front portion of the case body 31. A substantially horizontal flange 30*a* is formed so as to extend from an upper portion of the outer surface of the case body 31 to the opposite side surfaces of the extension part 32. A substantially horizontal partition wall 4*a* is formed on the inner surface of the under cover 4 so that the inner edge thereof is in contact with the flange 30*a*. A space defined by the extension case 3, the under cover 4 and the cowling 5 of the outboard engine 1 is divided by the partition wall 4*a* and the flange 30*a* into the engine room 6 and a lower space formed under the engine room 6 by a narrow portion of the under cover 4 and the extension case 3. The lower space under the engine room 6 communicates with the ambient space by means of gaps between the extension case 3 and the under cover 4. Water that leaks in the lower space does not cause any trouble.

The upper surface of the engine block 11 from which the crankshaft 7 projects upward is covered with a first cover 50. The cover 50 opens downward and covers the ac generator 17 and the coil starter 18. The upper surface of the cylinder head 13 from which the camshaft 20 projects upward is covered with a second cover 51. The second cover 51 opens downward and covers the cam pulley 21. The first cover 50 and the second cover 51 are joined together so as to define a continuous space enclosing the entire timing belt 22.

The second cover 51 serving as a rear belt cover will be described with reference to FIGS. 2 to 5. The second cover 51, i.e., a rear belt cover, has a semicircular rear top wall 51*a*, a rectangular front top wall 51*b* extending forward from the straight front end of the semicircular rear top wall 51*a*, and a side wall 51*c* extending downward from the edges of the top walls 51*a* and 51*b* excluding the front edge of the front top wall 51*b*. The second cover 51 covers the cam pulley 21 and part of the timing belt 22. Mounting lugs 51*f* provided with a hole project from right and left positions of the lower edge of a rear portion of the side wall 51*c*.

Extension walls 51*d* respectively having curved edges extend laterally from the right and the left side of the semicircular rear top wall 51*a*, respectively. A side wall 51*e* extends upward from a bottom wall consisting of the semicircular rear wall 51*a* and the extension walls 51*d* and 51*d* to define a vessel defining a cavity 52 opening upward. The bottom wall of the vessel formed of the semicircular rear wall 51*a* and the extension walls 51*d* and 51*d* slopes down toward the front. Drain holes 52*a* are formed in the lowest portions of the right and the left extension walls 51*d*, i.e., front end portion facing to ward the tilt shaft 37. Connecting pipes 53 projecting downward from the right and the left extension walls 51*d* are connected to the drain holes 52*a*, respectively.

The second cover 51 is disposed over the cylinder head 13 so as to cover the cam pulley 21 and part of the timing belt 22. The second cover 51 is fastened to the engine block 11 by fitting holding projections 14*a* formed in the cylinder head cover 14 in the holes of the mounting lugs 51*f* of the second cover or by screwing bolts inserted in the holes of the mounting lugs 51*f* in threaded holes formed in the cylinder head cover 14.

The connecting pipes 53 projecting downward from the extension walls 51*d* serving as part of the bottom wall of the vessel defining the cavity 52 are positioned outside the right and the left portions of the side wall 51*c* covering the cam pulley 21 and part of the timing pulley 22. Drain pipes 54 extended along the outer surface of the cylinder head 13 have upper ends connected to the connecting pipes 53 and lower ends penetrating the flange 30*a* of the oil case 30 and projecting into the lower space under the engine room 6.

Engine cover 5 covers or cowling the first cover 50 and the second cover 51. The cowling 5 and the under cover 4 define the engine room 6. The cowling 5 will be described with reference to FIGS. 6 to 8. The cowling 5 has a top wall 5*a* and a side wall 5*b* and is formed in the shape of an inverted, somewhat longitudinally elongate bowl. A mounting boss 5*c* is formed in a front lower portion of the side wall 5*b*. A base end of a hook 60 is fastened with screws to the mounting boss 5*c*. A rectangular opening 5*d* for supporting a grip 18*a* included in the recoil starter 18 on the outer side of the cowling 5 is formed in a front upper portion of the side wall 5*b*. A mounting boss 5*e* is formed in a rear lower portion of the side wall 5*b* of the cowling 5. A fastening member 61 is fastened to the mounting boss 5*e* with screws. A laterally elongate, rectangular opening 71 is formed in a rear upper portion of the side wall 5*b*. A horizontal, rectangular tube 72 is formed by extending walls horizontally into a space in the cowling 5 from the brim of the rectangular opening 71. A vertical, rectangular tube 73 is extended vertically downward from the inner end of the horizontal, rectangular tube 72. The horizontal, rectangular tube 72 and the vertical rectangular tube 73 form an air inlet duct 70.

A tilt handle 80 is formed of the upper wall 72*a* of the horizontal, rectangular tube 72, which serves as a handgrip, a rear end portion 5*g* of the top wall 5*a*, and an upper rear end portion 5*f* of the side wall 5*b*, extending over the rectangular opening 71. The tilt handle 80 thus formed of the upper wall 72*a* of the horizontal, rectangular tube 72, the rear end portion 5*g* of the top wall 5*a* and the upper rear end portion 15*f* of the side wall 5*b* has a substantially U-shaped cross section. The power unit of the outboard engine 1 can be tilted up by inserting the fingers of a hand through the rectangular opening 71 into the engine room 6 so that the palm of the hand is put to the upper rear end portion 5*f* of the side wall 5*b* and the fingers are put to the upper wall 72*a* of the horizontal, rectangular tube 72, and turning the cowling forward by the hand. The tilt handle 80 is formed integrally with the cowling 5, and the rear end portion 5*g* of the top wall 5*a*, the upper wall 72*a* of the horizontal, rectangular tube 72, and the upper rear end portion 5*f* of the side wall 5*b* are formed continuously so as to form a structure having a U-shaped cross section. Therefore the tilt handle 80 has a sufficiently high rigidity even if the component walls thereof are not thick.

A vertical wall 74 extends upward and the rear wall of the vertical rectangular tube 73 extends downward from the front end of the lower wall of the horizontal, rectangular tube 72 of the air inlet duct 70. The upper end of the vertical wall 74 is on a level below that of the upper wall 72*a* to form an air inlet opening between the upper wall 72*a* and the vertical wall 74. Air flows through the rectangular opening 71 formed in the rear portion of the cowling 5, the horizontal, rectangular tube 72 and the vertical, rectangular tube 73 into the engine room 6. Air that flows into the engine room 6 carries water. Some part of water carried by air is caught and separated from air by walls defining the rectangular opening 71, the walls forming the horizontal, rectangular tube 72 and the vertical wall 74 set upright on the front end of the lower wall of the horizontal, rectangular tube 72. Thus, water carried by air is separated from the air in a plurality of steps before the air reaches the vertical, rectangular tube 73.

Since the cowling 5 is provided integrally with the tilt handle 80 and the air inlet duct 70, man-hours for making the component parts of the outboard engine 1 and assembling the same can be reduced, and hence the manufacturing cost of the outboard engine 1 can be easily reduced.

Figure 9:
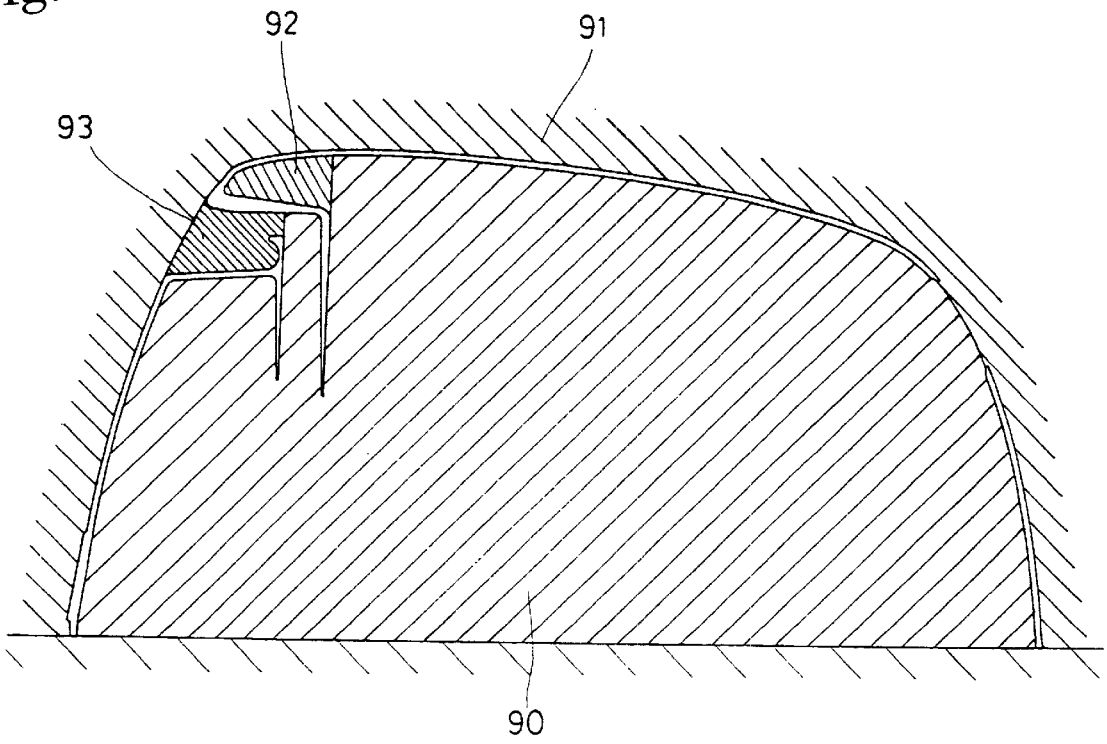
FIG. 9 is a sectional view of a mold for forming the cowling shown in FIG. 6 by casting.

The cowling 5 can be made by a casting process using a composite mold shown in FIG. 9. The composite mold has a male mold 90, a female mold 91, a male-side core 92, and a female-side core 93. The male mold 90 and the female mold 91 determine the general shape of the cowling 5. The male-side core 92 forms a hollow in the tilt handle 80 and the female-side core 93 forms a hollow in the horizontal, rectangular tube 72. Thus, the cowling 5, the tilt handle 80 and the air inlet duct 70 can be jointly formed as an integral unitary member by the casting process using the composite mold shown in FIG. 9.

Figure 10:
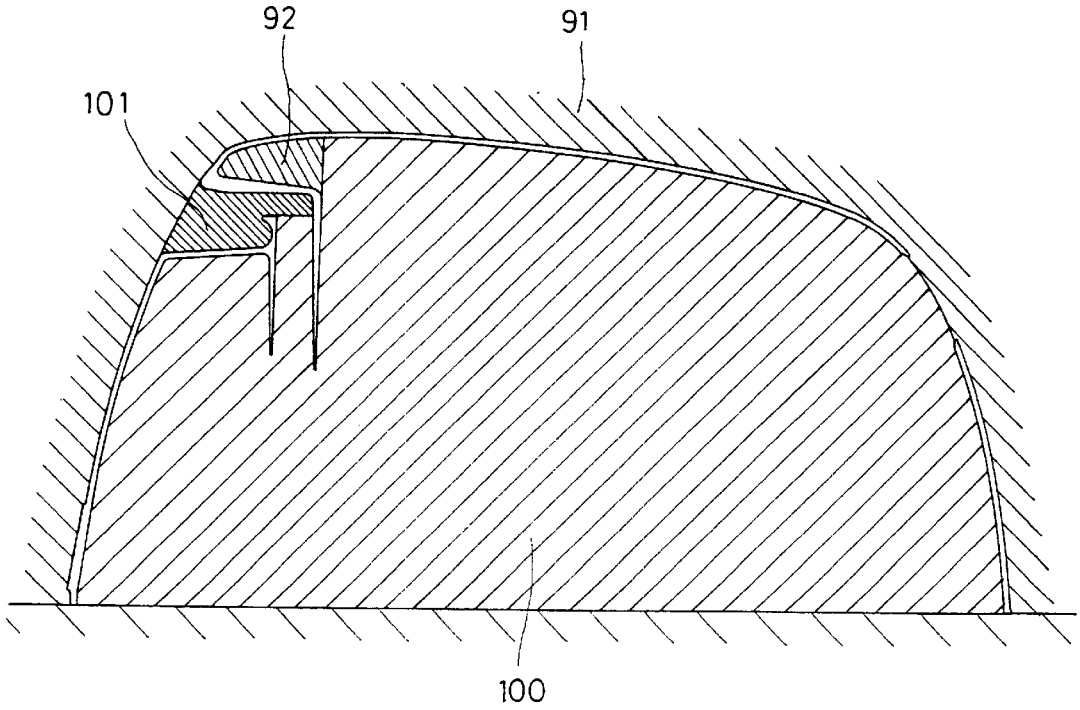
FIG. 10 is a sectional view of another mold for forming the cowling shown in FIG. 6 by casting.

The cowling 5 can also be made by a casting process using a composite mold shown in FIG. 10. The composite mold shown in FIG. 10 has a female mold 91, a male-side core 92, a male mold 100 and a female-side core 101. The female mold 91 and the male-side core 92 of the composite mold shown in FIG. 10 are the same as the female mold 91 and the male-side core 92 of the composite mold shown in FIG. 9. The female-side core 101 extends into an upper end portion of the vertical, rectangular tube 73, and a portion of the male mold 100 corresponding to the hollow in the vertical, rectangular tube 73 terminates on a level corresponding to that of the upper end of the vertical wall 74.

The cowling 5 is set so as to cover the engine 10. The cowling 5 is firmly joined to the upper end of the under cover 4 by engaging the hook 60 attached to the front end of the cowling 5 with the brim of an opening 32*b* formed in the front end of the extension part 32 of the oil case 30 and engaging a fastening lever 62 supported on an upper rear end portion of the under cover 4 with the fastening member 61.

The stern bracket 36 is clamped to the stern member S of the boat, and the swivel bracket 35 of the power unit of the outboard engine 1 is connected to the stern bracket 36 by the tilt shaft 37 so that the power unit of the outboard engine 1 can be tilted. Thus the power unit of the outboard engine 1 can be tilted up by putting a hand to the tilt handle 80 of the cowling 5 and turning the cowling 5 forward.

When the cowling 5 is joined to the under cover 4 so as to cover the engine 10, the lower end of the vertical, rectangular tube 73 of the air inlet duct 70 is located in and opens into the cavity 52 defined by the vessel formed on the second cover 51 covering the cylinder head 14. Water carried by air that flows through the rectangular opening 71 of the air inlet duct 70 formed in the cowling 5 is prevented from scattering in the engine room 6 by the air inlet duct 70 and is separated from the air in steps by the horizontal, rectangular tube 72. Water still carried by the air flowing through the vertical, rectangular tube 73 is collected in the cavity 52 of the vessel formed on the second cover 51. The water collected in the cavity 52 is drained outside the engine room 6 through the drain holes 52*a* formed in the lowest portions of the right and the left extension walls 51*d*, and the drain pipes 54 extended in the engine room 6 and penetrating the flange 30*a* of the oil case 30 and projecting into the lower space under the engine room 6. The water collected in the cavity 52 can be surely drained outside the engine room 6 when the outboard engine 1 is in either a tilted-up state or a steering state because the drain holes 52*a* are formed at positions facing toward the tilt shaft 37.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. An outboard engine comprising:

a power unit including a body structure, an engine disposed in an upper portion of the body structure, a propeller shaft supported for rotation on a lower portion of lie body structure so as to be driven by the engine, and a cowling detachably attached to the body structure so as to cover the engine from above and to define a part of an engine room;

a tilt bracket connected to the body structure of the power unit;

a stem bracket to be clamped to a boat; and a tilt shaft pivotally connecting the tilt bracket to the stem bracket so as to be tilt handle;

wherein the cowling is provided integrally with a tilt handle to be gripped by hand when tilting the power unit, and an air inlet structure positioned adjacent to and under the tilt handle and defined by an integral continuation of the tilt handle;

the cowling having the shape of an inverted bowl with a substantially horizontal top wall and a side wall, an outer opening of the air inlet structure being formed in an upper rear portion of the side wall, a wall extending substantially horizontally from an upper brim of the outer opening into a space defined by the cowling to form a horizontal handgrip, and the tilt handle including a rear end portion of the substantially horizontal top wall, an upper rear end portion of the side wall, extending over the outer opening, and the horizontal handgrip, and has a substantially U-shaped cross section.

2. The outboard engine according to claim 1, wherein:

the air inlet structure includes a horizontal tube having walls substantially horizontally extending from a lower brim and opposite side brims of the outer opening into the engine room defined by the cowling, and the horizontal handgrip that serves as an upper wall of the horizontal tube, and an inner end portion of the lower wall of the horizontal tube is bent upward into a vertical wall having an upper edge on a level lower than that of the horizontal handgrip such that an inner opening of the air inlet structure is defined between the vertical wall and the horizontal handgrip.

3. The outboard engine according to claim 2, wherein:

the air inlet structure further includes a vertical tube extended substantially vertically downward from the inner end of the horizontal tube into the engine room defined by the cowling, the vertical tube is continuous with the horizontal tube, the upper surface of the engine is covered with a covering member having a bottom wall and a side wall and defining a cavity opening upward, and the lower end of the vertical tube opens into the cavity defined by the covering.

4. The outboard engine according to claim 3, wherein the covering member is provided in its bottom wall with drain holes to drain water collected in the cavity of the covering member outside the engine room.

5. The outboard engine according to claim 4, wherein the covering member serves also as a belt cover for covering a timing belt, and the drain holes are formed in inner portions of the covering member closer to the tilt shaft and drain pipes extending outside from the engine room are connected to the drain holes.

6. An outboard engine comprising:

a power unit including a body structure, an engine disposed in an upper portion of the body structure, a propeller shaft supported for rotation on a lower portion of the body structure so as to be driven by the engine, and a cowling detachably attached to the body structure so as to cover the engine from above and to define a part of an engine room;

a tilt bracket connected to the body structure of the power unit;

a stern bracket to be clamped to a boat; and a tilt shaft pivotally connecting the tilt bracket to the stern bracket so as to be tilt handle;

wherein the cowling is provided integrally with a tilt handle to be gripped by hand when tilting the power unit, and an air inlet structure positioned adjacent to and under the tilt handle and defined by an integral continuation of the tilt handle; and said cowling, said tilt handle and said air inlet structure being molded as a unitary member.

7. The outboard engine according to claim 6, wherein:

said tilt handle forms a portion of said air inlet structure.

8. The outboard engine according to claim 6, wherein:

said tilt handle extends continuously from a wall of said cowling.

9. The outboard engine according to claim 8, wherein:

said tilt handle extends inwardly of said wall of said cowling.

10. The outboard engine according to claim 8, wherein:

said tilt handle has no moving parts.

11. The outboard engine according to claim 8, wherein:

said air inlet structure includes means for separating water from air entering said engine room through said air inlet structure.

12. The outboard engine according to claim 6, wherein said air inlet structure has an air inlet opening that is positioned adjacent to and under the tilt handle.

13. A cowling for an outboard engine apparatus having a power unit with an engine, which outboard engine apparatus may be tilted relative to a boat when mounted to the boat, the cowling comprising:

a main portion detachably attachable in covering relation to the engine from above so as to define a part of an engine room of the apparatus;

a tilt handle to be gripped by hand when tilting the apparatus relative to the boat; and an air inlet structure for the apparatus, wherein said tilt handle and said air inlet structure are integrally formed with sad main portion, said air inlet structure being positioned adjacent to and under the tilt handle and defined by an integral continuation of the tilt handle, and said main portion, said tilt handle and said air inlet structure being molded as a unitary member.

14. The cowling according to claim 13, wherein:

said tilt handle forms a portion of said air inlet structure.

15. The cowling according to claim 13, wherein:

said tilt handle extends continuously from a wall of said main portion.

16. The cowling according to claim 15, wherein:

said tilt handle extends inwardly of'said wall of said main portion.

17. The cowling according to claim 13, wherein:

said tilt handle has no moving parts.

18. A cowling for an outboard engine apparatus having a power unit with an engine, which outboard engine apparatus may be tilted relative to a boat when mounted to the boat, the cowling comprising:

a main portion detachably attachable in covering relation to the engine from above so as to define a part of an engine room of the apparatus;

a tilt handle to be gripped by hand when tilting the apparatus relative to the boat; and an air inlet structure for the apparatus, wherein said tilt handle and said air inlet structure are integrally formed with said main portion, said air inlet structure being positioned adjacent to and tinder the tilt handle and defined by an integral continuation of the tilt handle, and said air inlet structure includes means for separating water from air entering the engine room through said air inlet structure.

* * * * *

UNITED STATES PATENT AND TRADEMARK OFFICE

CERTIFICATE OF CORRECTION

PATENT NO. : 6,488,552 B2 
DATED : December 3, 2002
INVENTOR(S) : Kunihiro Kitsu, Hideki Nemoto and Nobuo Haga It is certified that error appears in the above-identified patent and that said Letters Patent is hereby corrected as shown below:

Title page,
Item [57], ABSTRACT,
Line 7, change “defining” to -- define --;
Line 9, change “clamped” to -- which clamps --.

Column 1,
Line 23, after “Thus” insert a comma.
Line 24, after “duct” delete the comma.
Line 25, change “cowling and” to -- cowling, and --.
Line 33, change “is there for” to -- is, therefore, --; after “invention” delete the comma.
Line 36, change “is not” to -- does not --.

Column 2,
Line 7, change “the lower wall of” to -- a lower wall of the --.
Line 17, change “be-separated” to -- be separated --.
Line 50, after “objects” insert a comma.

Column 3,
Line 53, change “born” to -- borne --.

Column 4,
Line 2, change “a extension” to -- an extension --.

Column 5,
Line 42, change “to ward” to -- toward --.
Line 63, change “5 covers or cowling” to -- or cowling 5 covers --.

Column 7,
Line 67, change “lie” to -- the --.

Column 8,
Lines 6 and 7, change “stem” to -- stern --.
Line 8, change “so as to be tilt handle” to -- so as to be tiltable --.
Line 55, change “covering.” to -- covering member --.

Column 9,
Line 8, change “so as to be tilt handle” to -- so as to be tiltable --.

UNITED STATES PATENT AND TRADEMARK OFFICE

CERTIFICATE OF CORRECTION

PATENT NO. : 6,488,552 B2 
DATED : December 3, 2002
INVENTOR(S) : Kunihiro Kitsu, Hideki Nemoto and Nobuo Haga It is certified that error appears in the above-identified patent and that said Letters Patent is hereby corrected as shown below:

Column 10,
Line 5, change "sad" to -- said --.
Lines 17 and 18, (2nd line of claim 16), change "of'said" to -- of said --.
Line 34, change "tinder" to -- under --.

Signed and Sealed this

First Day of July, 2003

JAMES E. ROGAN
*Director of the United States Patent and Trademark Office*